US005941298A

United States Patent [19]

Pleschiutschnigg

[11] Patent Number: 5,941,298

[45] Date of Patent: Aug. 24, 1999

[54] OPTIMIZED SHAPES OF CONTINUOUS CASTING MOLDS AND IMMERSION OUTLETS FOR CASTING SLABS OF STEEL

[75] Inventor: Fritz-Peter Pleschiutschnigg, Duisburg, Germany

[73] Assignee: SMS Schloemann-Siemag Aktiengesellschaft, Düsseldorf, Germany

[21] Appl. No.: 09/041,069

[22] Filed: Mar. 12, 1998

[30] Foreign Application Priority Data

Mar. 17, 1997 [DE] Germany ..... 197 10 791

[51] Int. Cl.[6] ..... B22D 11/00; B22D 11/04

[52] U.S. Cl. ..... 164/418; 164/459; 164/467

[58] Field of Search ..... 164/418, 467, 164/459, 488, 489, 437

[56] References Cited

U.S. PATENT DOCUMENTS

| | | | |
|---|---|---|---|
| 4,512,386 | 4/1985 | Haller | 164/467 |
| 4,635,702 | 1/1987 | Kolakowski et al. | 164/418 |
| 4,955,428 | 9/1990 | Schrewe | 164/418 |
| 5,467,809 | 11/1995 | Arvedi et al. | 164/418 |
| 5,730,207 | 3/1998 | Pleschiutschnigg | 164/459 |
| B1 4,635,702 | 4/1996 | Kolakowski et al. | 164/418 |

*Primary Examiner*—Patrick Ryan
*Assistant Examiner*—Anjan Dey
*Attorney, Agent, or Firm*—Friedrich Kueffner

[57] ABSTRACT

An oscillating mold for continuously casting slabs, preferably of steel, has long side walls and short side walls freely movable relative to the long side walls, and an immersion outlet. The long side walls define a center-symmetrical casting funnel having a funnel shape which is configured such that the distance between the long side walls in the casting funnel is reduced toward the outlet end of the mold and that in the meniscus area and at least along the length of the immersion outlet the funnel shape corresponds to or follows the outer cross-sectional size of the immersion outlet. The long side walls have adjacent the casting funnel a shape which is linear and planar over the mold length and center-symmetrical and concave transversely of the mold length.

14 Claims, 5 Drawing Sheets

FIG. 1a
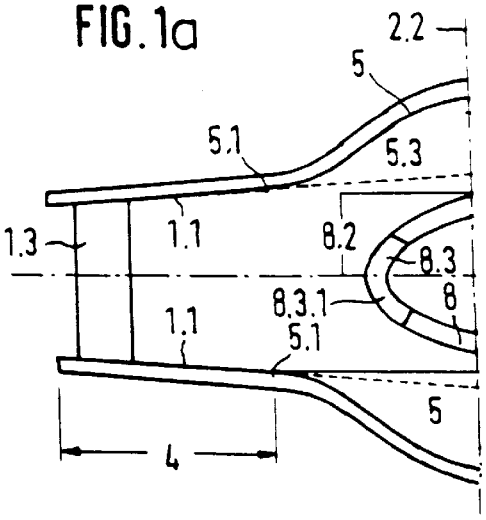
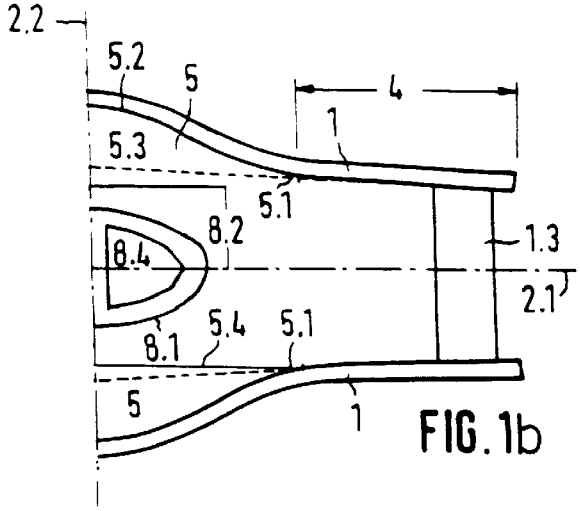
FIG. 1b
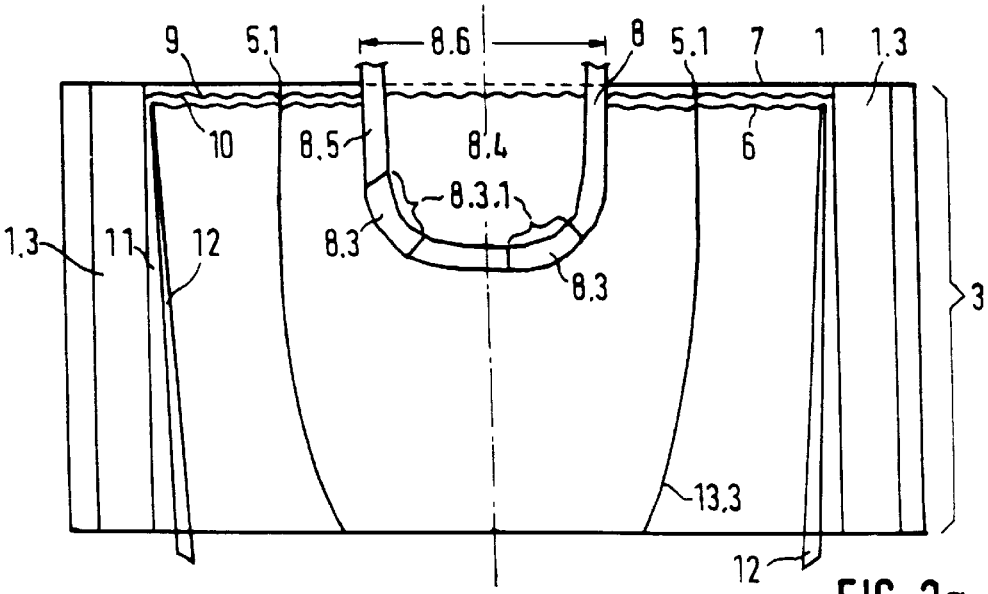
FIG. 2a
FIG. 3a
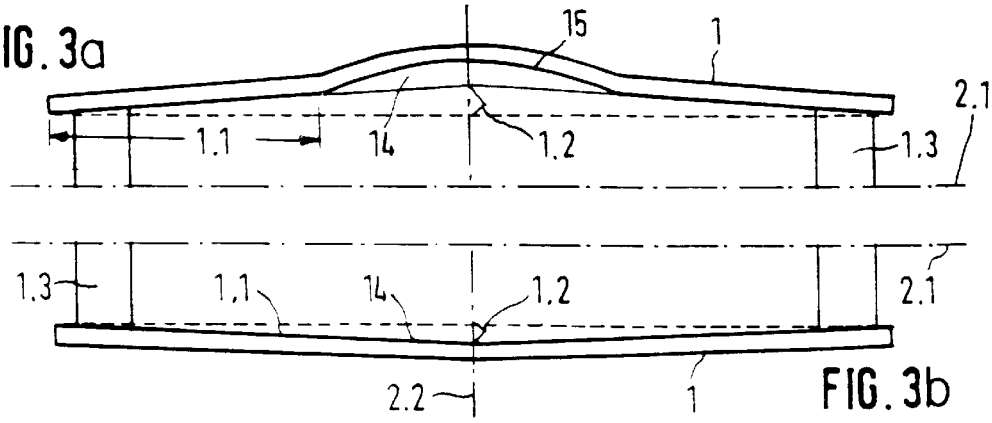
FIG. 3b

OPTIMIZED SHAPES OF CONTINUOUS CASTING MOLDS AND IMMERSION OUTLETS FOR CASTING SLABS OF STEEL

BACKGROUND OF THE INVENTION

1. Field of the Invention

The present invention relates to an oscillating mold for continuously casting slabs, preferably of steel, with immersion outlet and continuous casting powder.

2. Description of the Related Art

Continuous casting takes place particularly in sizes with a thickness range of between 20 and 250 mm, preferably 40 to 150 mm (thin slabs), and with widths of between 500 and 3,300 mm, preferably 500 to 1,800 mm, with casting speeds of at most 10 m/min.

Previously known slab molds or thin slab molds which are open by providing a funnel or trough in the casting meniscus can be divided into the following groups and have the following advantages and disadvantages.

German Patent 887 990 describes a funnel-type mold with a rectangular mold outlet opening, wherein the mold consists of a single unit and does not have short side walls which are independent of the long side walls. This mold does not make it possible in the case of different continuous casting speeds and steel qualities to adjust the conical shape of the short side walls to the shrinkage dimension of the strand in the width direction over the height of the mold and it also does not make it possible to cast different strand widths. In addition, there is the danger that the strand shell will be jammed in the mold which leads to rupture of the strand shell as it is being discharged.

German Patent 34 00 220 describes a funnel-type mold with long side walls and short side walls in which laterally next to the funnel-shaped pouring area is arranged a parallel area which corresponds at least to the thickness of the cast strip or the thin slab. This mold eliminates the disadvantages of the mold according to the above-described German Patent 887 990.

Japanese Patent document 58-86906 describes a mold which is concavely shaped independently of the shape of the immersion outlet and has a residual conical shape at the mold outlet opening. Simultaneously, the extent by which the concave shape is reduced over the mold length is greater than the shrinkage of the slab over the mold width, so that the conicality of the short side walls becomes negative or the strand width is greater at the mold outlet opening than in the casting meniscus area. In addition, this solution does not ensure a uniform slag formation over the strand width because the active strand thickness is not uniform at the meniscus for melting the casting powder. This non-uniform slag formation can also be observed in German Patent 36 27 991.

German Patent 41 31 829 describes a four-plate thin slab mold which has a concave shape in the area of the smallest slab width. The maximum opening in the casting meniscus area and in the slab middle is 12 mm for each 1,000 m slab width.

This mold shape has the disadvantage that in the area between the long side walls of the mold and the immersion pipe, which is very narrow as compared to the area outside of the immersion pipe (at most 2×0.25 slab thickness+12 mm), a deficiency of casting slag as well as a deficiency of fresh melt occurs which lead to an increased thermal flux and shrinkage behavior as well as to undercooling and bridge formation between the strand shell and the immersion outlet. These disadvantages result in a high susceptibility to longitudinal cracks at the slab surface in the area around the slab middle.

German Patents 44 03 045 and 44 03 050 describe concave mold shapes, but no statements are made concerning a relationship between the concave mold shape and the outer and inner immersion outlet shapes. This missing optimization of the shapes relative to each other results in problems in the thermal flux over the mold width and mold height as well as in the steel flow in and below the casting meniscus which, in turn, increases the danger of the formation of longitudinal cracks.

In European Patent Application 0 109 357 A1, the immersion outlet or immersion pipe are not taken into consideration when selecting the concave mold shape. In addition, this European Patent application deals with molds for casting aluminum with the use of electromagnetic fields, i.e., the strand does not have any contact with the mold when the strand shell is formed.

Moreover, no casting powder is used and the mold does not oscillate. In addition, casting is not carried out continuously, but so as to rise in a type of block casting mold.

In addition to the thin slab molds discussed above, the classic slab mold with the rectangular dimensions of, for example, 200×2,000 mm, shall be discussed. Aside from the fact that the casting speed is at most 2 m/min and the thermal flux and, thus, the shrinkage is only about 1 $MW/m^2$ and about 1%, this standard mold system has the following deficiencies in spite of a relatively thick slag film between the strand shell and the mold of, for example, 1 to 2 mm thickness.

- non-uniform slag formation over the strand width in the area of the immersion pipe;
- undercooling of the steel in the area of the immersion pipe as compared to the area next to the immersion pipe;
- impairment of the shrinkage of the strand shell in the horizontal direction by the parallel mold shape, particularly in the case of wide slab sizes.

SUMMARY OF THE INVENTION

Therefore, it is the primary object of the present invention, with a defined immersion outlet, to find a mold shape which with respect to

- the casting capacity,
- the inner and outer shape,
- the flow cross-sections,
- the outlet openings in size and arrangement, and
- wall thickness (maximum casting time, number of melts in sequential casting)

meets the following requirements:

- uniform slag formation over the slab width,
- uniform and quiet bath movement,
- low-friction and uniform shrinkage of the strand shell over the width of the slab,
- casting of different slab widths in one mold (large adjustment range), and
- adjustment of different conical positions of the short side walls by control and by regulation.

In accordance with the present invention, an oscillating mold for continuously casting slabs includes the following elements. An immersion outlet with an inner flow cross-section, a wall thickness, an outlet cross-section and an outer cross-sectional size with a width and a thickness. A center-symmetrical, concave shape of the long side wall plates, wherein the shape is linear and planar over the length of the mold. Freely movable short side walls. A center-symmetrical funnel additionally provided in the wide side walls, wherein the funnel corresponds to the outer cross-sectional shape of the immersion outlet at least in the area of the casting meniscus and is reduced at least partially in the direction toward the mold outlet.

The features of the oscillating mold according to the present invention were not readily apparent to those skilled in the art. The solution of the above-described object according to the present invention is independent of the type of mold, such as a vertical mold, a vertical bending mold or a circular-arc mold.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 1*a* and 1*b* are schematic top views of a funnel-type mold showing two types of immersion outlets;

FIGS. 2*a*, 2*b* and 2*c* are side views of the funnel-type mold showing three different funnel shapes;

FIGS. 3*a* and 3*b* are top views of the funnel-shaped mold at the mold outlet showing two outlet opening shapes.

DESCRIPTION OF THE PREFERRED EMBODIMENTS

Experiments carried out in developing the invention and casting experience gathered have shown that, for a rupture-free casting and for sequential casting over a desired long casting period of, for example, at most 24 hours, and a casting speed of at most 10 m/min for producing faultless strand surfaces, the shape of the mold in connection with the configuration or shape of the immersion outlet is of significant importance for the desired casting capacity.

Figure 2B:
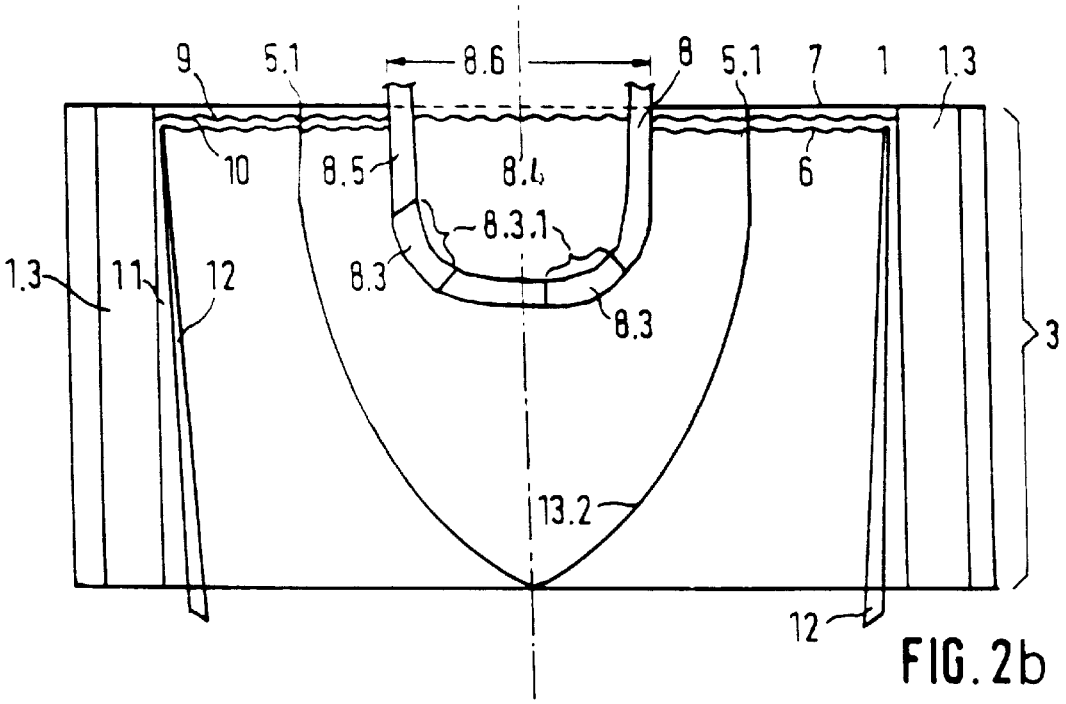
Figure 2C:
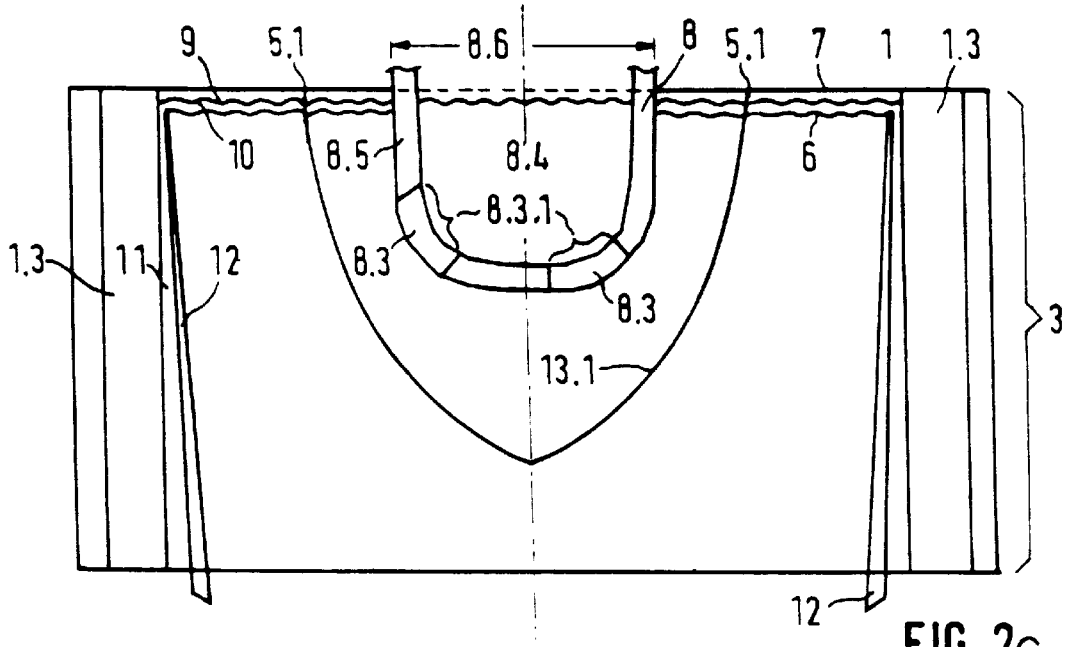
Figure 4A:
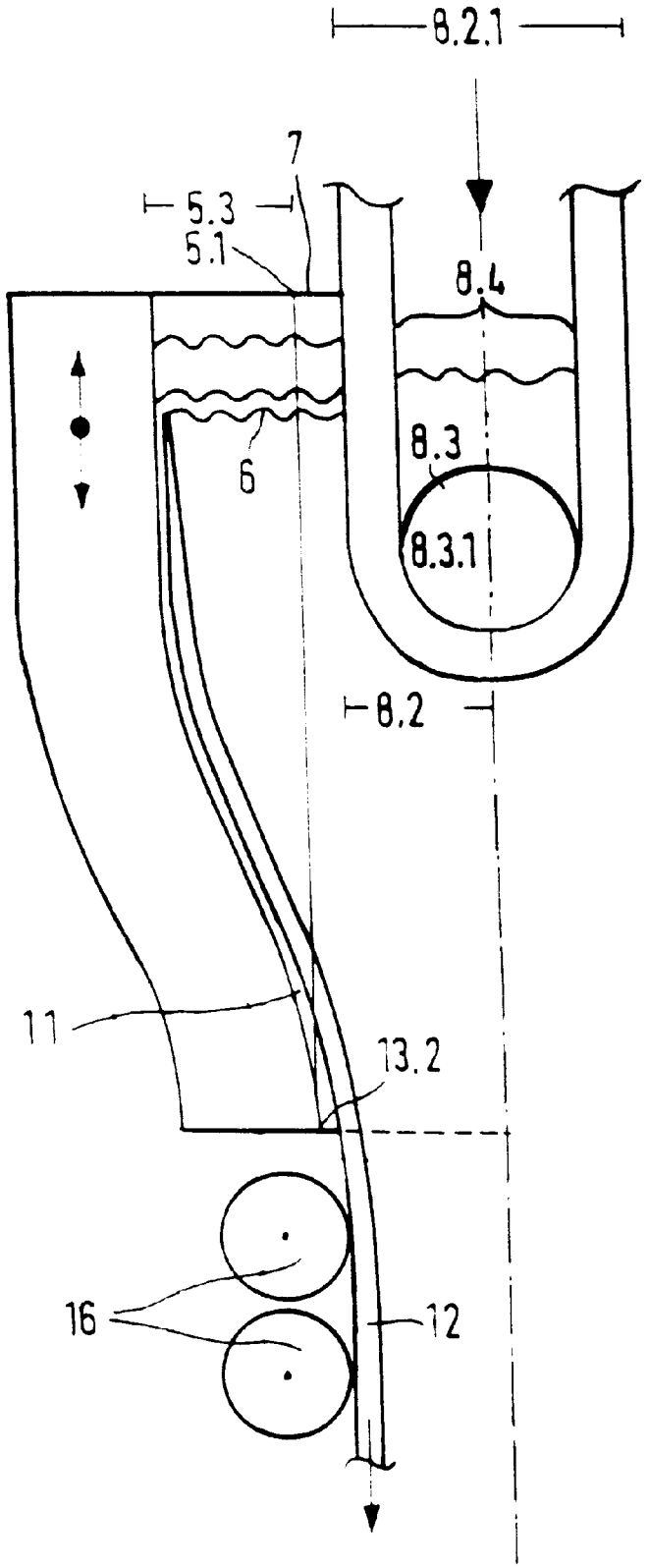
FIGS. 4*a,* 4*b* and 4*c* are side views of the funnel-shaped mold showing three different funnel shapes and immersion outlets.
Figure 4B:
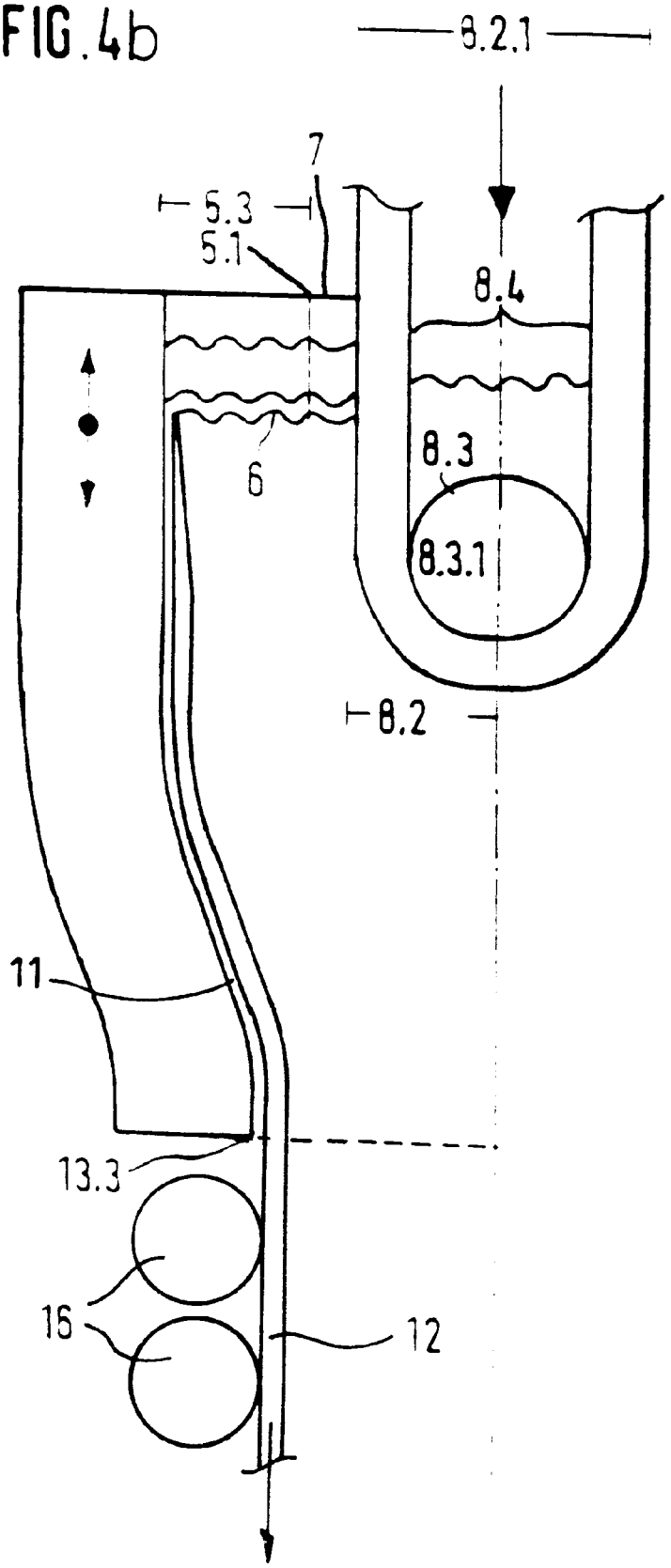
Figure 4C:
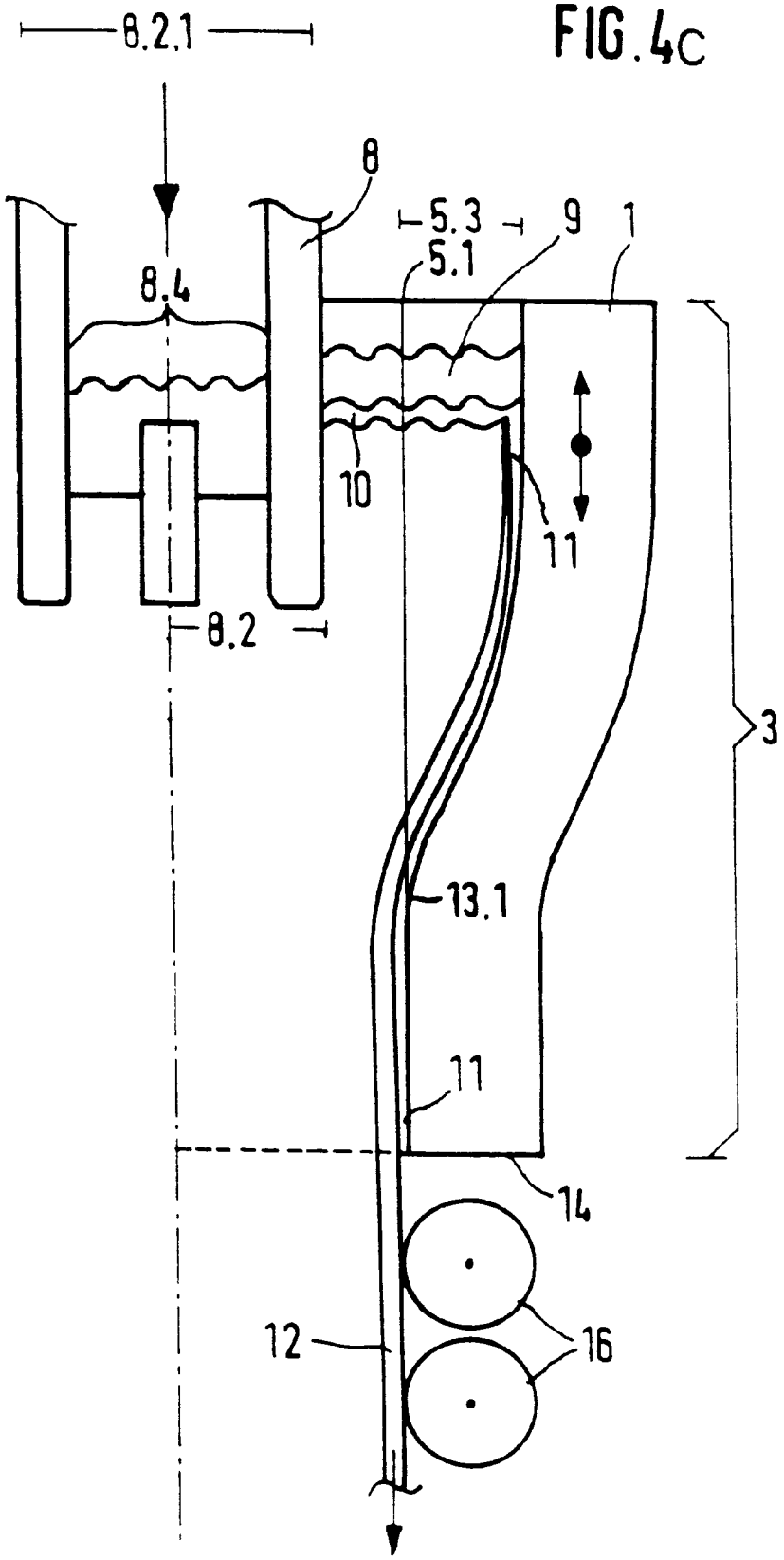

FIGS. 1*a*–4*c* of the drawing show an example of the invention with its features.

The long side walls 1 of the mold have a concave shape 1.1 over the entire mold height 3, wherein the shape 1.1 is linear or planar and symmetrical relative to the center axis 2. This concave linear shape extends over the area of the longitudinal side wall adjustment up to the rim 5.1 of the funnel 5 in the casting meniscus area 6 or at the upper edge of the mold 7. This concave and planar opening of the mold 1.2, which corresponds to a rhombus, should—compared to the rectangular mold—correspond at most to about 4% of the thickness of the short side walls 1.3 or casting thickness in the area of the short side walls.

In order to ensure an optimum width adjustment and conicality regulation, the long side walls 1 should be movable hydraulically in a position-controlled and force-controlled manner toward the short side walls 1.3.

The shape 5.2 of the funnel 5 in the casting meniscus corresponds to the shape 8.1 of the immersion outlet 8 and has an opening 5.3 of preferably 140% of half the immersion outlet thickness 8.2 or 70% of the immersion outlet thickness 8.2.1.

Because of the desired maximum casting time (sequential casting of, for example, 24 hours) and the casting capacity in t/min of, for example, 5 t/min, and the resulting optimum flow speed of, for example, 1 m/sec at the immersion outlet openings 8.3 having the opening cross-section 8.3.1, the immersion outlet itself has a desired inner flow cross-section 8.4 of, for example, 9,000 $mm^2$, a desired immersion outlet wall thickness 8.5 of, for example, 30 mm, and an opening cross-section 8.3.1 of, for example, 7,000 $mm^2$.

The immersion outlet shape, essentially determined by the casting capacity and the maximum desired casting time, determines the shape of the funnel 5 in the meniscus area 6 as well as below the meniscus.

Preferably, the opening of the funnel 5.3 in the meniscus area should be about half the immersion outlet thickness 8.2 and the funnel width 5.4 should correspond about to the immersion outlet width 8.6, so that the casting powder 9 is built up to a uniform slag thickness 10 on the meniscus and, thus, to a uniform slag film 11 between the strand shell and the long side wall 1 of the mold. The opening of the funnel in the meniscus area on each long side should be at most 70% of the total immersion outlet thickness 8.3.1 because the specific thermal conductivity of the refractory material (based on alum-graphite) is about 7–10 W/°K. m as compared to steel of about 50, slag of about 1 and Cu of about 360 W/°K, and this relatively low conductivity leads to a significant undercooling of the strand, particularly in the case of a rectangular mold. The opening of the mold by using a funnel counteracts this undercooling between the immersion outlet 8 and the mold wall 1, because of the low conductivity of the immersion outlet material, and compensates this undercooling in the case of a funnel opening 5.3 of >50% of the immersion pipe thickness.

This funnel shape 5.2 in the meniscus area 6 which is superimposed on the concave, linear and planar long side wall shape in the middle of the long sides may be reduced by using three alternative types of configurations determined essentially by the immersion outlet shape 5.2 underneath the meniscus.

The reduction of the funnel to the concave, planar long side wall shape 1.1 is described by the enveloping curve 13. Thus, the funnel can be reduced or taken back over a portion of the mold height 13.1, preferably 75%, with a total mold height 3 of, for example, 1,200 mm. Also, in the case of shorter molds or sensitive steel qualities, it is possible to reduce the funnel ago shape in a more gentle manner.

This can be realized by having the enveloping curve 13.2 extend over the entire mold height 3 or even past the mold outlet opening 14, i.e., at the mold outlet a residual funnel 15 is still superimposed in a center-symmetrical manner over the concave, linear long side wall shape 1.1.

In the case the funnel 5 is reduced within the mold height 3 through the enveloping curves 13.1 or 13.2, the strand can be guided with its convex, center-symmetrical 1.1, linear cross-sectional shape to the end of the strand guiding means 16 or into the rolling mill, or the strand is shaped in the area of the strand guiding means 16 into a rectangular size.

In the case of a convex strand size at the mold outlet 4, which has a residual camber corresponding to the residual funnel 15, the size can be maintained up to the end of the strand guide means, the strand can be maintained partially, or the strand can also be reduced to a rectangular shape.

In addition to the optimized conditions with respect to the flow, the bath movement, the slag guidance, the thermal flux, and the shrinkage behavior, this type of the mold according to the present invention with its specific funnel shape contributes to centering of the strand in the mold and in the strand guide means and to a high casting safety (avoidance of ruptures), particularly in the case of high casting speeds of up to 10 m/min.

These very complex processes during casting of thin slabs and slabs, particularly at high casting speeds, are taken into consideration by the features described in the claims. As compared to the prior art, the present invention provides the following specific advantages in the case of thin slab casting as well as slab casting:

the feature of concave linear and planar long side wall shape leads to low-friction shrinkage of the strand shell in the horizontal direction, maximum width adjustment range due to minimum funnel shape independent of the total strand width (for example 500–2,000 mm), width adjustment also during casting, conicality control or regulation of the short side walls during casting, and longitudinal crack-free slab surfaces.

the feature of the funnel results in free selection of the immersion outlet shape with respect to maximum casting capacity t/min, flow speeds m/s due to flow cross-sections at the immersion outlet and at the immersion outlet openings, maximum casting time/sequential casting (for example, 24 hrs.) due to free selection of the immersion outlet wall thickness (30 mm at 1 mm/h slag wear), uniform meniscus movement, suppression of turbulences, uniform temperature gradients at the meniscus from the mold center to the strand shell over the entire mold width, no danger of bridge formation between strand shell and immersion outlet wall, uniform melting of slag over the width of the meniscus, uniform formation of the slag film between the strand shell and the long side mold plates, uniform thermal flux density over the mold width, uniform shrinkage behavior of the strand shell over the mold width, primarily in the horizontal direction, good and crack-free surface even in the case of longitudinal crack-sensitive steel qualities, such as peritectic steels, centering of the strand in the mold and the strand guide means, high casting safety or lowest rupture rates, and possibility of producing a concave, center-symmetrical slab.

While specific embodiments of the invention have been shown and described in detail to illustrate the inventive principles, it will be understood that the invention may be embodied otherwise without departing from such principles.

I claim:

1. An oscillating mold for continuously casting slabs, the oscillating mold comprising long side walls and short side walls freely movable relative to the long side walls, the long side walls and short side walls having a meniscus area and defining a mold outlet, the oscillating mold further comprising an immersion outlet located between the long side walls and short side walls, the immersion outlet having an inner flow cross-section, a length, a wall thickness, an outlet cross-section and an outer cross-sectional size with a thickness extending in a direction parallel to the long side walls and a width extending perpendicularly of the direction of the thickness, the long side walls defining a center-symmetrical casting funnel having a funnel shape configured such that a distance between the long side walls in the casting funnel is reduced at least partially in a direction toward the mold outlet and so as to correspond in the meniscus area and at least along the length of the immersion outlet to the outer cross-sectional size of the immersion outlet, the long side walls having adjacent the casting funnel a shape which is linear and planar over a mold length and center-symmetrical and concave perpendicularly of the mold length, wherein the concave shape of the long side walls constitutes a maximum opening of 4% of a thickness of the short side walls, and wherein an opening of the funnel shape in the meniscus area corresponds to at most 70% of the immersion outlet thickness or at most 140% of half the immersion outlet thickness.

2. The oscillating mold according to claim 1, wherein the funnel shape is reduced completely within the mold and the mold has at the mold outlet a concave, linear shape.

3. The oscillating mold according to claim 1, further comprising a strand guide means underneath the mold for at least partially maintaining a strand with a convex, symmetrical and linear cross-section.

4. The oscillating mold according to claim 1, further comprising a strand guide means for changing the convex, symmetrical and linear cross-section of the strand into a rectangular size.

5. The oscillating mold according to claim 1, wherein the funnel shape is reduced within the mold only partially toward the mold outlet, such that, in addition to the convex, linear, cross-section, the strand has an additional center-symmetrical camber corresponding to a residual funnel shape.

6. The oscillating mold according to claim 5, further comprising a strand guide means underneath the mold for at least partially maintaining a strand with a convex, symmetrical and linear cross-section.

7. The oscillating mold according to claim 5, further comprising a strand guide means for changing the convex, symmetrical and linear cross-section of the strand into a rectangular size.

8. The oscillating mold according to claim 1, wherein the short side walls are adjustable at least up to a transition between the concave, linear shape of the long side wall and the funnel shape.

9. The oscillating mold according to claim 1, wherein the funnel shape has a minimum width of 500 mm.

10. The oscillating mold according to claim 1, further comprising means for hydraulically moving the long side walls in a position-controlled and force-controlled manner toward the short side walls.

11. The oscillating mold according to claim 1, wherein the inner flow cross-section of the immersion outlet is up to 20,000 $mm^2$, the wall thickness of the immersion outlet is 20 to 40 mm, and a total opening cross-section at the immersion outlet opening is up to 15,000 $m^2$.

12. The oscillating mold according to claim 11, wherein the inner flow cross-section of the immersion outlet is up to 9,000 $mm^2$, the wall thickness of the immersion outlet is 30 mm, and the total opening cross-section at the immersion outlet opening is up to 7,000 $m^2$.

13. The oscillating mold according to claim 1, wherein an immersion outlet opening of the immersion outlet has in relation to a predetermined casting capacity an optimized cross-section selected such that a flow speed at the outlet opening is up to 2 m/sec.

14. The oscillating mold according to claim 13, wherein the flow speed is about 1 m/sec.

* * * * *